United States Patent [19]

Randolph

[11] Patent Number: 4,599,948

[45] Date of Patent: Jul. 15, 1986

[54] RAILWAY HOPPER GATE LOCKING ASSEMBLY

[75] Inventor: Robert W. Randolph, St. Charles, Mo.

[73] Assignee: ACF Industries, Incorporated, New York, N.Y.

[21] Appl. No.: 346,712

[22] Filed: Feb. 8, 1982

[51] Int. Cl.[4] ..... B61D 7/14; B61D 7/20; B61D 7/26

[52] U.S. Cl. ..... 105/282 P; 105/308 P

[58] Field of Search ..... 105/282 P, 308 P, 282 R

[56] References Cited

U.S. PATENT DOCUMENTS

| | | | |
|---|---|---|---|
| 3,682,105 | 8/1972 | Marulic | 105/308 P |
| 3,707,126 | 12/1972 | Nester | 105/308 P |
| 3,877,392 | 4/1975 | Akester et al. | 105/308 P |

*Primary Examiner*—Howard Beltran

*Attorney, Agent, or Firm*—H. W. Cummings; E. N. Riddle

[57] ABSTRACT

In accordance with the present invention a locking member is integrally connected to a transversely extending operating shaft. A handle is preferably provided on at least one end of the operating shaft. A locking lug and a tripping element are integrally connected to a movable gravity gate. In closed position the locking member has a hook portion which engages the locking lug. The locking member is movable to a generally vertical position by rotation of the operating shaft. As the gate is moved toward open position the tripping element engages the locking member and pivots the locking member to a generally horizontal position. As the gate is further opened, gravity urges the locking member into a further rotation position in which a depending safety tip on the locking member is below a fixed stop located adjacent the outlet wall with the locking member generally horizontal and not resting on the gate. The length of the safety tip is such that it cannot rotate to the generally vertical open position because it is prevented from doing so by the gate. The safety tip is essentially trapped between the gate and the stop. As the gate is closed the locking lug rotates the hook portion of the locking member until the locking member drops into locked position engaging the locking lug.

7 Claims, 5 Drawing Figures

RAILWAY HOPPER GATE LOCKING ASSEMBLY

BACKGROUND OF THE INVENTION

In U.S. Pat. No. 3,707,126 granted Dec. 26, 1972, locking members (61) are disclosed which in closed position engage the end of a gravity gate rack. The locking member is attached to an operating shaft (56) which is rotatable to move the locking member to a vertical position (FIG. 7) allowing the gate to move toward open position. However, the locking member includes a depending leg (61*b*) which is engaged by an extension from the gate (36) and pivots the locking member into a tripped position resting on the gate where it remains while the gate assumes the full open position.

When the gate is moved toward closed position the locking member is again pivoted by the extension (36) and in closed position the locking member again engages the rack end.

However, if the gate were left in open position and a strong impact were applied to a railway car upon which the outlet is mounted, the locking member could pivot back to the vertical position and not in engagement with the rack end holding the gate in closed position. In this event, the gate could again move to the open position in transit.

SUMMARY OF THE INVENTION

The object of the invention is to provide a gravity outlet locking assembly in which the possibility of the locking member pivoting to the open position with the gate open after an impact to the outlet is avoided.

In accordance with the present invention a locking member is integrally connected to a transversely extending operating shaft. A handle is preferably provided on at least one end of the operating shaft. A locking lug and a tripping element are integrally connected to a movable gravity gate. In closed position the locking member has a hook portion which engages the locking lug. The locking member is movable to a generally vertical position by rotation of the operating shaft. As the gate is moved toward open position the tripping element engages the locking member and pivots the locking member to a generally horizontal position. As the gate is further opened, gravity urges the locking member into a further rotated position in which a depending safety tip on the locking member is below a fixed stop located adjacent the outlet wall. The length of the safety tip is such that it cannot rotate to the generally vertical open position because it is prevented from doing so by the gate. The safety tip is essentially trapped between the gate and the stop. As the gate is closed the locking lug rotates the hook portion of the locking member until the locking member drops into locked position engaging the locking lug.

IN THE DRAWINGS

DESCRIPTION OF PREFERRED EMBODIMENTS

Figure 1:
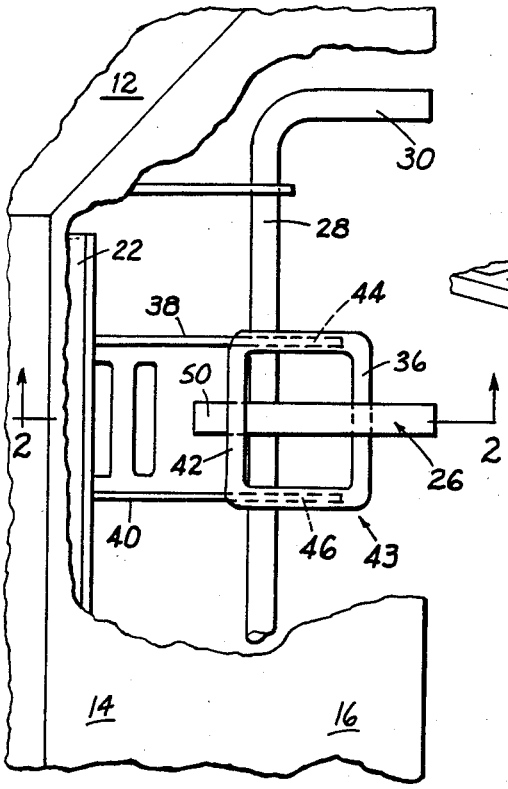
FIG. 1 is a partial plan view of the outlet locking assembly of the present invention.
Figure 2:
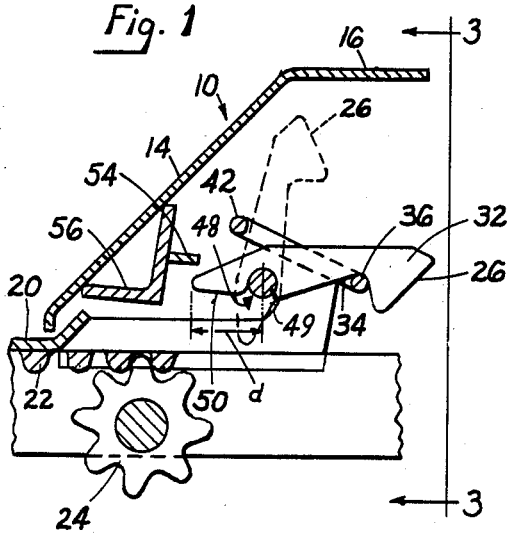
FIG. 2 is a vertical sectional view looking in the direction of the arrows along the line 2—2 in FIG. 1.
Figure 3:
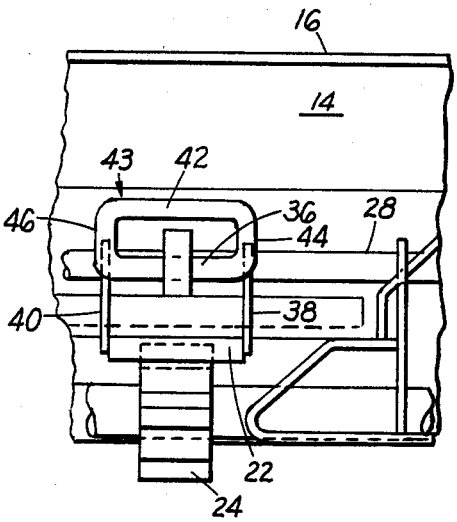
FIG. 3 is a front elevation view looking in the direction of the arrows along the line 3—3 in FIG. 2.
Figure 5:
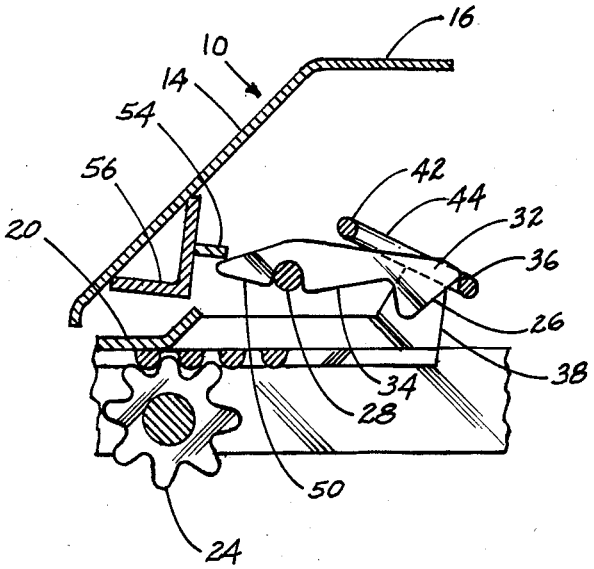
FIG. 5 is a vertical sectional view with the gate in open position ready to be moved into closed and locked position.

In the drawings a gravity outlet is illustrated at 10. The outlet includes a pair of conventional side walls 12 located on either side of the outlet, one of which is illustrated in FIG. 1, and a pair of end walls 14 located at either end of the outlet, one of which is illustrated in FIGS. 2 and 3. A flange portion 16 is provided to mount the outlet upon a suitable hopper, for example, a railway hopper car.

A gravity gate 20 is movable longitudinally of the outlet and a rack 22 is integrally connected as by welding to the outer end of the gate 20. A pinion 24 is provided, engagable with the rack to move the rack and gate between open and closed positions.

A locking element 26 is provided which is integrally attached to a transversely extending operating shaft 28 which has a handle 30 on at least one side of the outlet. The locking member 26 includes a nose portion 32 and a locking slot 34. A locking lug 36 is integrally connected to a gate or rack for example, by means of vertical supports 38 and 40 shown in FIG. 3. A single unitary support may be used if desired. In closed position, the locking lug 36 and thus the gate 20 is held in closed position by the nose 32.

Figure 4:
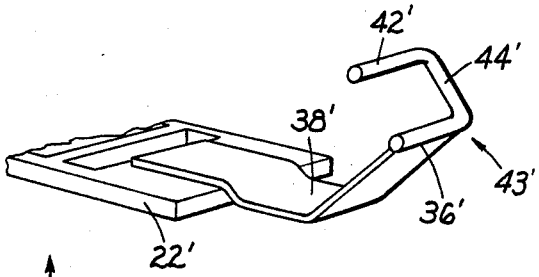
FIG. 4 is a view of an alternative support and integral locking lug and tripping element arrangement.

A tripping element 42 is also provided. As is illustrated in FIGS. 1 to 3, the tripping element 42 is conveniently formed integral with the locking lug 36 being connected thereto by means of a pair of connecting webs 44 and 46. However, it is to be born in mind that the tripping element 42 need not be integral with the locking lug, and these need not be separately supported. However, the integral rectangular ring 43 is an inexpensive and convenient way of forming and assembling the two parts together. FIG. 4 illustrates a C-shaped locking lug 36' and tripping element 42' connected by a web 44'. An integral support 38' is connected to the rack 22'.

Locking member 26 further comprises a slot 48 containing a weld 49 which integrally connects the locking member to the shaft 28. A safety tip 50 is located on the opposite portion of locking elements 26 and extends a distance (d) outwardly from shaft 28 such that this distance exceeds the distance that shaft 28 is located above the gate 20.

In closed position the rack is located inwardly relative to the shaft 28 such that the safety tip 50 may be rotated into the vertical position shown in dotted lines in FIG. 2 without engaging the rack.

In the alternate embodiment shown in FIG. 4, while a support 38' for the rectangular ring 43' is provided, the support 38' is depressed as shown in FIG. 4 to provide clearance to allow the safety tip to be rotated when the gate 20 is in closed position. A stop member 54 is integrally connected to hopper wall 14, for example, by means of an angle bracket 56 which is welded to the hopper wall. Stop 54 is located such that when locking member 26 is in generally horizontal position, stop 54 overlies the inner end of safety tip 50 preventing locking member from riding on gate holding the lock in a substantially horizontal position.

In operation, in closed position the locking member 26 is in the position shown in solid lines in FIG. 2 with the locking lug 36 being held in place by the nose 32. In order to move the gate 20 from the closed to the open position, the shaft 28 is first rotated by means of the handle 30, which pivots the locking member 26 into the generally vertical position illustrated in dotted lines in FIG. 2, resting against the tripping element 42. Since the gate 20 is in closed position as shown in both FIGS. 2 and 4, clearance is provided to allow rotation of locking element 26 to the vertical position. Locking member 26 will remain in this position so that a single attendant can carry out the opening of the gate. The attendant next utilizes a bar or other appropriate tool (not shown), to rotate the pinion gear 24 which engages the rack 22 and moves the gate 20 outwardly from left to right toward open position. Since the tripping element 42 is integral with the gate, this pivots the locking member 26 in a clockwise direction into a generally horizontal position. However, nose 32 will be to the left of locking lug 36 which has also moved outwardly with the gate. As the gate moves outwardly the upper gate extension shown in FIG. 2 is below both the shaft 28 and the nose 26 of the locking member. As the gate is moved further outwardly, gravity will further pivot the locking member in a clockwise direction. However, as this occurs, safety tip 50 engages stop 54, thus holding the locking member in a generally horizontal reset position above gate 20. Since the safety tip 50 extends outwardly from the shaft 28 a greater distance (d) than the shaft 28 extends above the gate 20, it is not possible for the locking member to be pivoted to the vertical position shown in dotted lines in FIG. 2, by inadvertent rotation or by impact. Thus this dimensional relationship of the safety tip is an important feature of the present invention. The safety tip is essentially trapped between the lug 54 and the gate 20, and thus is always in a suitable reset position when the gate is open.

Thus when the gate is moved towards closed position, the locking member is in position to be pivoted upwardly by the locking lug 36 along the nose 32 until the locking members drops by gravity and the locking lug rests in the slot 34, holding the gate in closed position.

What is claimed is:

1. A gravity outlet locking assembly comprising: a locking member integrally connected to a transversely extending operating shaft; a locking lug and a tripping element integrally connected to a movable gravity gate; said locking member having a hook portion which in closed position engages said locking lug; said locking member being movable to a generally vertical position by rotation of the operating shaft; means for moving said gate between open and closed positions; whereby as said gate is moved toward open position said tripping element engages said locking member and pivots the locking member to a generally horizontal position; said locking member including a depending safety tip which is located below a fixed stop located adjacent the outlet wall; said safety tip extending outwardly from said shaft a greater distance than said shaft extends above the gate; whereby when the gate is in open position said locking member is restricted to movement between said gate and said fixed stop; and whereby as the gate is closed the locking lug rotates the hook portion of the locking member until the locking member drops into locked position engaging the locking lug.

2. A gravity outlet locking assembly according to claim 1, wherein a handle is provided on at least one end of the operating shaft.

3. A gravity outlet locking assembly according to claim 1, wherein said locking lug and said tripping element are formed as an integral element.

4. A gravity outlet locking assembly according to claim 3, wherein said tripping element and said locking lug are formed as a rectangular ring.

5. A gravity outlet locking assembly according to claim 3, wherein said integral element is supported by support means connected to said gate.

6. A gravity outlet locking assembly comprising: a locking member integrally connected to a transversely extending operating shaft; handle means located on at least one end of said shaft; an integral locking lug and a tripping element connected to a movable gravity gate; said locking member having a hook portion which in closed position engages said locking lug; said locking member being movable to a generally vertical position by rotation of the operating shaft; means for moving said gate between open and closed positions; whereby as said gate is moved toward open position said tripping element enages said locking member and pivots the locking member to a generally horizontal position; said locking member including a depending safety tip which is located below a fixed stop located adjacent the outlet wall; said safety tip extending outwardly from said shaft a greater distance than said shaft extends above the gate; whereby when the gate is in open position said locking member is restricted to movement between said gate and said fixed stop; and whereby as the gate is closed the locking lug rotates the hook portion of the locking member until the locking member drops into locked position engaging the locking lug.

7. A gravity outlet locking assembly according to claim 6, wherein said integral locking lug and tripping element are supported by a single support member connected to said gate.

* * * * *